United States Patent [19]

Avitzur

[11] 3,942,351

[45] Mar. 9, 1976

[54] MANUFACTURE OF HOLLOW WORKPIECES

[76] Inventor: Betzalel Avitzur, 817 N. 31st St., Allentown, Pa. 18104

[22] Filed: Sept. 26, 1974

[21] Appl. No.: 509,547

[52] U.S. Cl. ..... 72/271; 72/345

[51] Int. Cl.[2] ..... B21C 23/14; B21C 35/00

[58] Field of Search ..... 72/344, 345, 346, 271, 72/264

[56] References Cited

UNITED STATES PATENTS

| | | | |
|---|---|---|---|
| 3,144,132 | 8/1964 | Bridge | 72/271 |
| 3,343,388 | 9/1967 | Zeitlin et al. | 72/271 X |
| 3,402,591 | 9/1968 | Maeder | 72/345 |

*Primary Examiner*—Milton S. Mehr
*Attorney, Agent, or Firm*—Eric Michelson

[57] ABSTRACT

While performing an ironing operation (a specific kind of drawing operation) on a hollow workpiece by means of a mandrel or punch and a die, the workpiece is caused to leave the die at a speed exceeding the speed of the mandrel, and the resulting forward slip with respect to the mandrel is controlled. The required mandrel stroke is reduced. Stripping of the workpiece from the mandrel may be started while the workpiece is still in motion relative to the mandrel.

17 Claims, 14 Drawing Figures

MANUFACTURE OF HOLLOW WORKPIECES

This invention relates to the manufacture of hollow workpieces, and more particularly to the ironing of tubular or cup-shaped workpieces such as the bodies of cans for beverages or food preservation, shell bodies for ammunition, tubing, and the like, especially those which have thin walls.

In the manufacture of such workpieces, deep drawing or impact extrusion is normally used to first produce a heavy or medium gauge hollow blank or cup of restricted depth. The succeeding ironing operation which is a drawing operation of a specific kind, and which is performed by means of a mandrel or punch and a drawing die, serves to reduce the wall thickness of the hollow workpiece and to increase the length thereof in a suitable manner. The internal diameter of the workpiece remains substantially unchanged during ironing. After the ironing operation has been completed, the workpiece is stripped from the mandrel.

When using conventional methods, several ironing steps are normally necessary to obtain a desired reduction in wall thickness. Such procedure is relatively expensive. Moreover, when a single mandrel is used to pass the workpiece through a number of dies arranged in tandem or through a stepped die having several spaced ironing portions, the mandrel has a relatively long stroke and thus must be of considerable length, which often results in eccentricity in the ironed workpiece and non-uniformity in wall thickness thereof.

A method has heretofore been proposed which permits practically unlimited reductions during a single passage through a die having one ironing portion. This will increase the economy of the process and will reduce the required stroke and length of the mandrel and thus decrease the danger of eccentricity.

It is an object of the invention to reduce the stroke and length of the mandrel still further.

It is another object of the invention to achieve practically unlimited reductions by a single ironing step in an improved manner at high power efficiency.

It is an additional object of the invention to facilitate the stripping of the workpiece from the mandrel and to reduce the required stripping force.

Further objects and advantages of the invention will become apparent as the description proceeds.

In the drawings which illustrate the invention by way of example,

GENERAL DESCRIPTION OF IRONING

Figure 1:
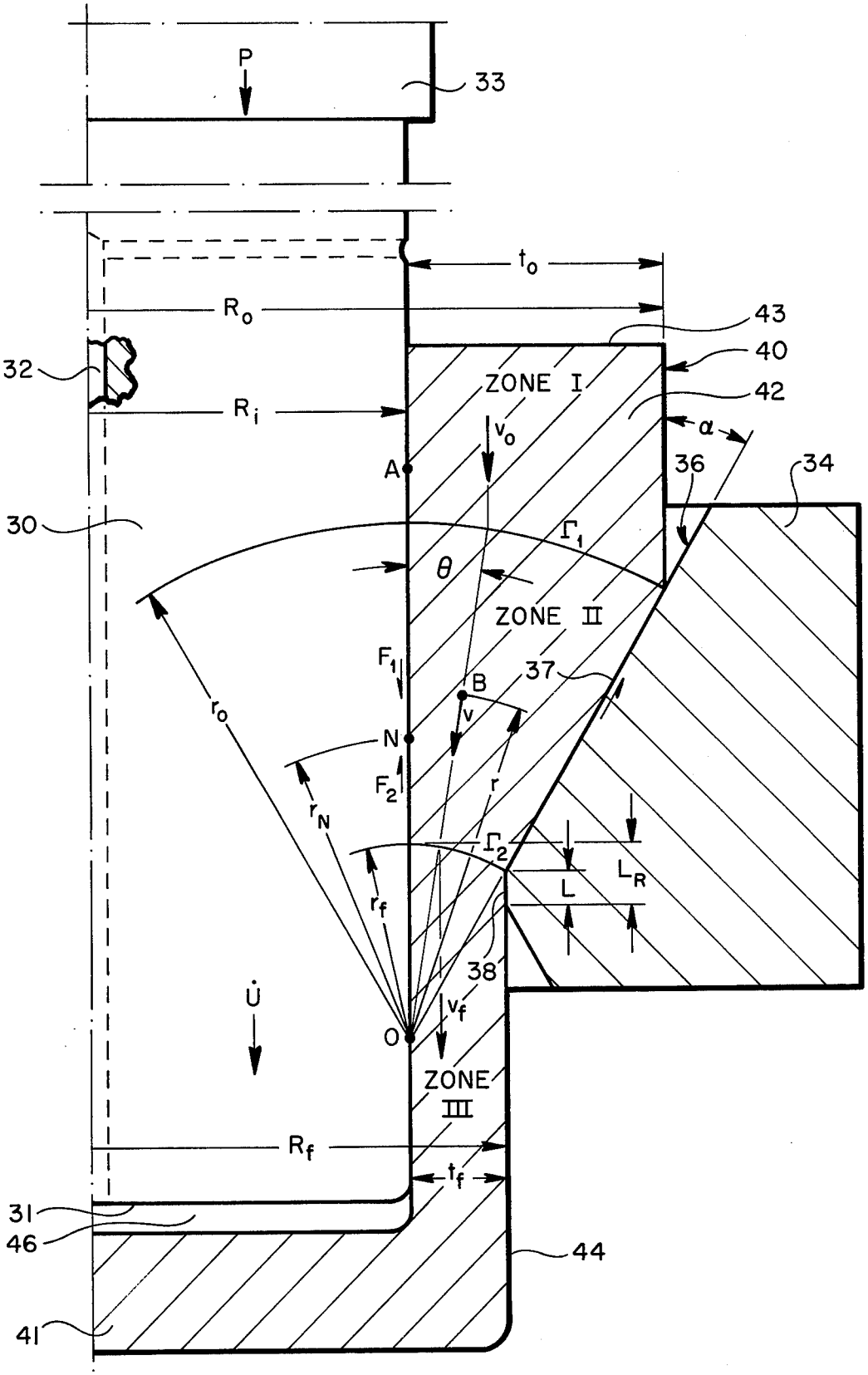
FIG. 1 is a diagrammatic fragmentary section showing the ironing of a cup-shaped workpiece in accordance with the invention.

Referring to FIG. 1, the arrangement shown therein comprises an ironing mandrel or punch 30 having a front face 31 and a coaxial bore 32 which extends through the punch. Instead of being coaxial, the bore may be eccentrically arranged if desired. The punch is connected at its rear to actuating means such as a ram 33 of a press. A die 34 cooperates with the punch and is provided with an aperture generally indicated at 36. This aperture 36 extends through the die and includes a tapered or conical portion 37 having a semi-cone angle $\alpha$, and a substantially cylindrical portion or land 38 of the length L. For better illustration, angle $\alpha$ is shown larger than normally used for the present purposes.

A hollow workpiece is generally indicated at 40 and consists of metal, e.g., aluminum, steel or the like. The workpiece shown here has a cup-like shape preformed during a preceding deep drawing or cupping operation to produce a can, in particular a beer can. It will be clear that instead of being cup-shaped, the hollow workpiece may be in the form of a tube as shown, for example, in FIG. 1*d* of my U.S. Pat. No. 3,685,337.

The workpiece or can 40 comprises a bottom 41 and an integral side wall 42 of tubular shape which extends to a rear or end face 43. Designating certain dimensions of the workpiece before ironing as original and after ironing as final, the side wall 42 has an original outer radius $R_o$, a substantially constant inner radius $R_i$ which further represents the outer radius of the punch, and an original wall thickness $t_o$ which is usually much smaller than the radius $R_i$. The bottom 41 may likewise have the original wall thickness $t_o$.

To perform an ironing operation, punch 30 is caused to engage the interior of the hollow workpiece 40 in a manner such that face 31 of the punch will originally contact bottom 41, the hole 32 of the punch providing for escape of fluid such as air from the interior of the workpiece. The punch with the workpiece thereon is then advanced into aperture 36 of the die so that material of the workpiece will be forced to flow through the conical portion 37 of the die aperture and the thickness of side wall 42 will be reduced while the length thereof will be increased so as to form an ironed portion 44 of the side wall. The ironed portion has a final outer radius $R_f$ which likewise represents the approximate inner radius of land 38 of the die, and a final wall thickness $t_f$ corresponding substantially to the width of the gap between punch 30 and land 38. The movement of punch 30 will normally be continued until the entire workpiece has been passed through die 34.

Ram 33 is adapted to exert a force indicated at P which is applied to punch 30 and may be transmitted to the workpiece partly through friction in the area of deformation and partly through pressure of front face 31 of the punch on botton 41 as long as face 31 contacts the bottom of the workpiece, deviating from the condition illustrated here in FIG. 1. Pressure on bottom 41 may cause the development of tensile stresses in wall portion 44 during ironing. If friction between punch and inner surface of the workpiece is increased, less tension is present in wall portion 44, thus permitting ironing with larger reductions in wall thickness.

To obtain practically unlimited reductions during one pass through a single die, friction at the punch should be higher than friction at the die and proper die angles should be selected as has been set forth heretofore. When the entire punch force P is transmitted to the workpiece by friction directly in the area of deformation, front face 31 of the punch will not exert any pressure upon bottom 41 of the workpiece and there will be no tension in portion 44 of the latter. In the case of such procedure, a requirement of minimum necessary reduction may replace the conventional criterion of maximum possible reduction.

Additional details of FIG. 1 will be explained in later parts of the description.

In subsequent calculations, the die friction factor or coefficient will be indicated by the symbol $m_1$, and the punch friction factor or coefficient by $m_2$. The symbol $\sigma_{xf}$ will be used for front pull stress or tension in the ironed portion 44 at the exit of the die. Back pull stress $\sigma_{xb}$ may occur at the entrance to the die, e.g., when deep drawing and ironing are combined and both are performed during the same stroke of the punch.

The symbol $\sigma_o$ will designate the nominal flow stress of the workpiece material, i.e., tensile stress at the yield point for a specimen of rod type. For hollow workpieces of the kind shown, the flow stress is slightly higher and equals $(2/\sqrt{3})\,\sigma_o$, i.e., approximately 1.15 $\sigma_o$. The relation of actual stress to flow stress $(2/\sqrt{3})\,\sigma_o$ will be called the relative stress. If $\sigma_{xf}/[(2/\sqrt{3})\,\sigma_o]$ equals one, the front pull stress has the highest permissible value and under otherwise equivalent conditions, relatively large reductions may be obtained.

When workpiece and punch leave the die at the same speed, there will be no sliding friction between workpiece and punch beyond the conical portion of the die aperture. Under such conditions, reductions in wall thickness obtainable during ironing are indicated by an equation stated in column 8, lines 41 to 45, of the aforementioned patent as follows:

$$\frac{t_o}{t_f} = \mathrm{EXP}\left\{\frac{\dfrac{\sigma_{xf}-\sigma_{xb}}{(2/\sqrt{3})\sigma_o} - \dfrac{1-\cos\alpha}{\sin\alpha} - \dfrac{m_1}{2}\cdot\dfrac{L}{t_f}}{\dfrac{E(\alpha,\sqrt{3}/2)}{\sin\alpha} + \dfrac{m_1}{2}\cot\alpha - \dfrac{m_2}{2\sin\alpha}}\right\} \qquad (1a)$$

wherein $E(\alpha, \sqrt{3}/2)$ = elliptic integral of second kind.

The following equation defines the elliptic integral:

$$E(\alpha, \sqrt{3/2}) = \int_o^\alpha \sqrt{1-\frac{3}{4}\sin^2\theta}\, d\theta \qquad (1b)$$

wherein $\Theta$ = angular coordinate (see FIG. 1).

Reference is made to pages 402 et seq. and 429 et seq. of my book, "Metal Forming: Processes and Analysis", McGraw-Hill Book Company, 1968, where the elliptic integral is treated and values thereof are stated for a range of $\alpha$ from 0 to 90° in a table on page 404. It will be apparent from this table that for small values of $\alpha$ not exceeding 55°, the elliptic integral can be approximated by sin $\alpha$ with an error not larger than 5%.

Eq. (1*a*) can be represented symbolically as:

$$\frac{t_o}{t_f} = f\left(\alpha, m_1, m_2, \frac{L}{t_f} \text{ and } \frac{\sigma_{xf}-\sigma_{xb}}{(2/\sqrt{3})\sigma_o}\right) \qquad (2)$$

Figure 2:
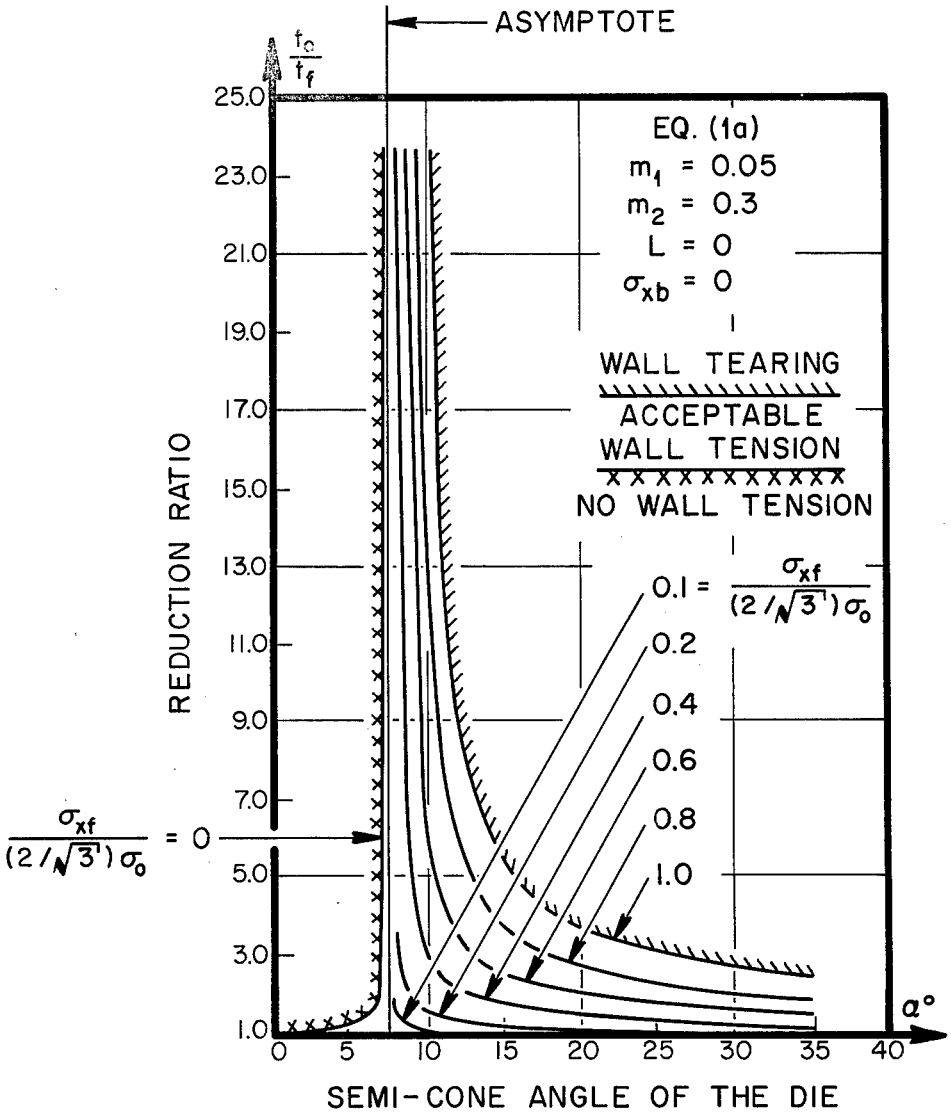
FIGS. 2 to 11 are diagrams plotting certain variables.

The characteristics of Eq. (1*a*) are shown in FIG. 2 in which the abscissa is the semi-cone angle $\alpha$ of the ironing die and the ordinate is the possible reduction ratio $t_o/t_f$. Die friction factor and mandrel friction factor are constant at their respective values of $m_1 = 0.05$, and $m_2 = 0.3$, while the length L of the land of the die is zero. It should be noted that the following description of FIG. 2 and the characteristics thereof prevail only when die friction is lower than mandrel friction. The parameter in FIG. 2 is the relative front tension. Back pull stress $\sigma_{xb}$ equals zero in FIG. 2 as is usually the case.

The most extreme line on the right of FIG. 2 indicates the possible reduction as a function of angle $\alpha$ when maximum wall tension is permitted. This characteristic has a vertical asymptote at a critical die angle of approximately 7.2° for the conditions shown in FIG. 2, and all the rest of the lines in the present figure have the same asymptote. Thus, moving from large die angles to small die angles, one starts with only small possible reductions which increase first gradually and then drastically as the die angle approaches its critical value. As the die angle becomes the critical angle of 7.2°, practically unlimited reductions can be obtained. Combinations of die angles and reductions to the right of and above the most extreme line at the right are not permissible because they would be associated with still higher wall tension which would cause bottom or wall tearing.

Selected lower values of wall tension, for example, $\sigma_{xf} = 0.8\,(2/\sqrt{3})\,\sigma_o$, result in lowering the reduction ratio somewhat for die angles larger than the critical angle, but the characteristic lines are similar.

This trend continues for smaller and smaller values of wall tension until a switch occurs in that for very small values, close to no wall tension at all, the characteristic line snaps to the other side of the critical angle. When no tension is permitted, $t_o/t_f$ starts at zero for zero die angle, increases first gradually with increasing angle values, and then rises drastically to be asymptotic to the vertical line at the critical die angle which is about 7.2° in the present FIG. 2. It will be clear that the characteristic line for $\sigma_{xf} = 0$, which is marked by crossed strokes, designates a reduction that can be made without any wall tension, the entire power being supplied by ram friction only. This line represents the criteria for the minimum reduction required for ironing without wall tension. Any practical reduction above this line can be achieved and no wall tension is expected. As stated, the area to the right of the family of characteristics is not suitable for ironing because of tearing. Between the two extreme lines, a varying degree of wall tension is expected.

Forward Slip

The invention is based on the observation that under certain conditions the ironed portion of the workpiece may be caused to leave the die at a speed exceeding the speed of the punch, which will result in forward slip of the ironed portion with respect to the punch so that a gap 46 will be formed. Hole 32 of the punch provides for ingress of air to avoid development of a vacuum.

As compared with prior methods, the required stroke of the punch is shorter by the axial extent of gap 46, and the length of the punch may be reduced by an equal amount. This will decrease the danger of workpiece eccentricity and resulting non-uniformity in wall thickness.

It has been found that during ironing, forward slip will occur only if punch friction is larger than die friction. Further, forward slip is possible in the area to the left of the family of characteristic lines in FIG. 2, where the operation is performed substantially without wall tension.

To keep the ironed portion free of tensile stresses, angle $\alpha$ will be made smaller than the critical value defined by an equation appearing in column 9, line 25, of the aforesaid patent. This may be indicated here as follows:

$$2E(\alpha, \sqrt{3/2}) + m_1 \cos\alpha - m_2 < 0 \quad (3)$$

Figure 3:
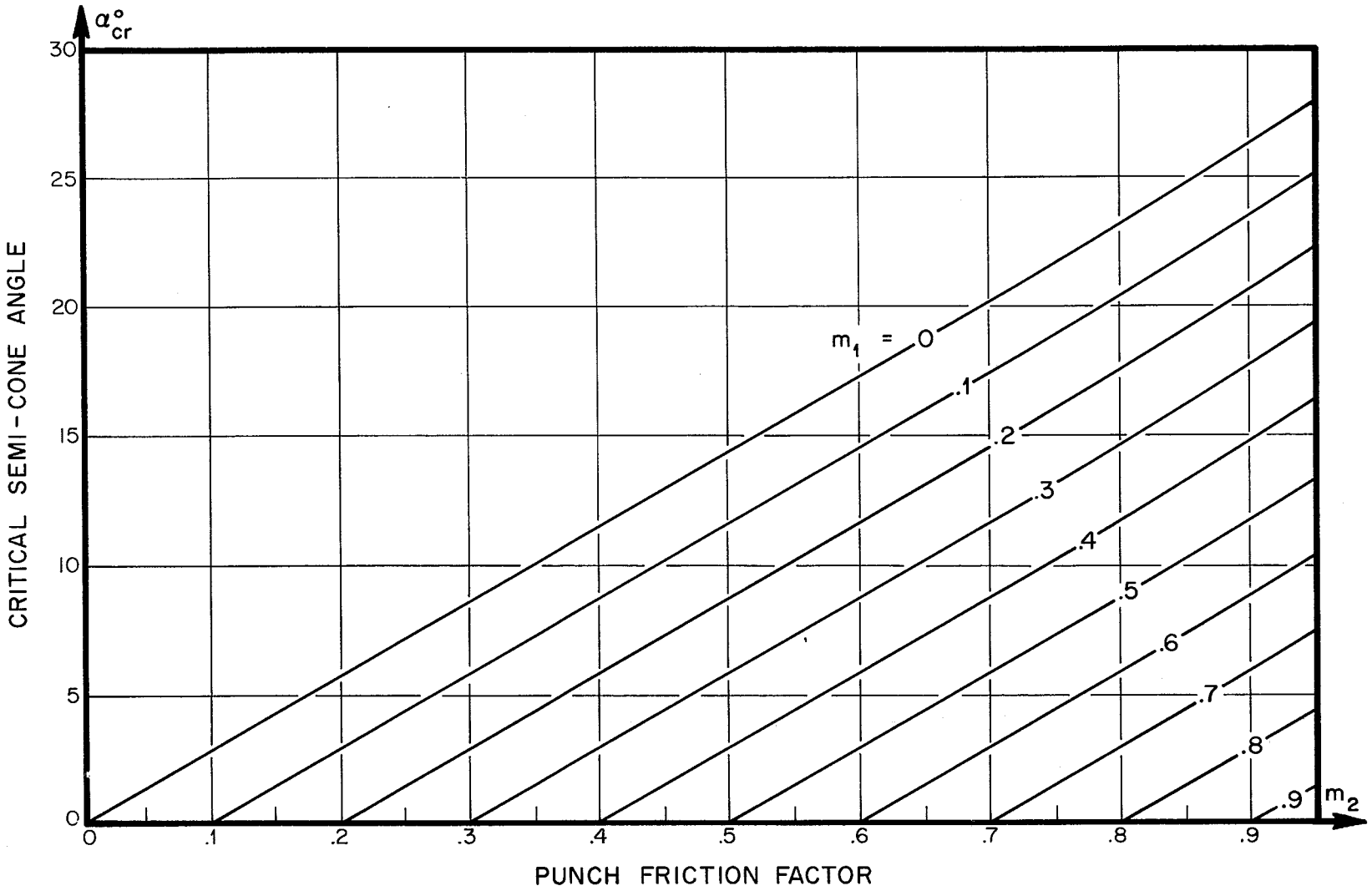

Expression (3) can be solved for $\alpha$ by a successive approximation method. The characteristics of expression (3) are plotted in FIG. 3, where the abscissa is the mandrel friction factor $m_2$, the ordinate is the critical semi-cone angle $\alpha_{cr}$, and the parameter is the die friction factor $m_1$. The diagram is valid for all values of L, the length of the land of the die. From FIG. 3 it will be observed that the value of the critical angle increases monotonically (almost linearly) with an increase in punch friction and with a decrease in die friction.

Where suitable, expression (3) may be approximated as follows:

$$\alpha \approx 28.5(m_2 - m_1) \quad (4)$$

Velocity Zones

Reverting to FIG. 1, it will be clear that the die 34 and punch or mandrel 30 are movable relative to each other. In the arrangement shown, the die is stationary while the punch is adapted to move downwards at an operational speed $\dot{U}$.

The velocity field indicated in FIG. 1 serves to approximately simulate the actual flow and to facilitate mathematical treatment by the upper bound approach.

There are three zones of velocity of the material. In Zone I where deformation has not started as yet, the material forming a rigid body moves downward in axial direction at an original velocity $v_o$. Zone I is bounded by the end face 43, by two cylinders of radii $R_i$ and $R_o$, respectively, and by a toroidal surface $\tau_1$ which in the sectional view is arc-shaped, and which has a coordinated center 0 and a radius $r_o$. Center 0 which represents an apex for angle $\alpha$ is located on a circle formed by intersection of the extended conical surface of the die aperture and the surface of the punch, the circle having the radius $R_i$.

In Zone II wherein plastic deformation takes place, any particle will move in an axial plane towards the respective center or apex O at a varying speed $v$. This zone is bounded by the toroidal surface $\tau_1$, by a cylindrical surface of radius $R_i$, by a toroidal surface $\tau_2$ formed about the apex O and having a radius $r_f$, and by a conical surface which is a portion of the inner conical surface 37 of aperture 36 of the die. Punch 30 and die 34 are considered here as rigid bodies.

In Zone III, the ironed portion 44 moves as a rigid body in the axial direction of the workpiece at a final velocity $v_f$. This zone is bounded by the toroidal surface $\tau_2$, by two cylinders of radii $R_i$ and $R_f$, and by a portion of the outer surface of bottom 41.

In the case of a thin-walled workpiece where $$t_o/R_0 << 1 \quad (5)$$

the relation of exit velocity $v_f$ to entrance velocity $v_o$ is calculated in view of volume constancy and may be approximated as follows:

$$\frac{v_f}{v_o} = \frac{R_o^2 - R_i^2}{R_f^2 - R_i^2} = \frac{1 - (R_i/R_o)^2}{(R_f/R_o)^2 - (R_i/R_o)^2} \approx \frac{t_o}{t_f} \quad (6)$$

When forward slip occurs, exit velocity $v_f$ is faster than punch velocity $\dot{U}$ which in turn is faster than entrance velocity $v_o$, that is, $$v_f > \dot{U} > v_o \quad (7)$$

Interface Conditions, Neutral Point, and Friction at Punch

Considering the conditions at the interface between punch and workpiece or can, a particle of the can originally located at point A and forming a part of the rigid body of material in Zone I will first move downward at the velocity $v_o$ which is slower than the punch velocity $\dot{U}$. Contact between the matching surfaces is loose here and the punch does not exert any appreciable frictional drag on the workpiece in Zone I.

As the particle passes the surface $\tau_1$, its motion downward is accelerated because of the convergent flow in Zone II. When the particle reaches a certain intermediate position N between $\tau_1$ and $\tau_2$, its speed is equal to the punch speed $\dot{U}$. Moving past point N, the velocity of the particle exceeds the punch speed. Point N will be called the neutral point because at that point there is no relative motion between punch and workpiece.

Above point N, the punch drags the workpiece along in Zone II by means of friction, forcing it to enter the gap between the punch and the die and to advance therein. The friction force $F_1$ (FIG. 1) is the sole motivating force when ironing with no wall tension is effected, and this frictional drag must supply power to deform the workpiece and to overcome friction losses due to contact of die and mandrel with the workpiece. When ironing with forward slip, the relative motion between the workpiece and the punch at the exit side of the neutral point N causes a reverse drag on the can. The corresponding force $F_2$ opposes the ironing motion.

When the particle passes the surface $\tau_2$, the land L of the die still exerts pressure on the workpiece, and thus a part of friction force $F_2$ is produced on the can surface below $\tau_2$. Gradually, the can leaves the die, and although can and punch are still in contact, friction diminishes.

Available net effective ram friction is:

$$F = F_1 - F_2 \quad (8)$$

The position of the neutral point between the surfaces $\tau_1$ and $\tau_2$ is flexible. It fluctuates with changing conditions, and may be classified as a pseudo-independent parameter. When power demand rises and exceeds the supply, the exit velocity automatically slows down, the neutral point moves to the exit, increasing $F_1$, decreasing $F_2$, and the effective power supply rises to restore balance between supply and demand. The precise reverse occurs when the power supply exceeds the demand. The exit velocity rises and balance is restored. Fluctuations in the position of the neutral point have the effect of an automatic, instant feedback loop control. When power demand increases so greatly that it forces the neutral point to move to surface $\tau_2$, and $v_f$ is equal to $\dot{U}$, a condition of instability is reached. Higher power demand will not be satisfied due to depletion of friction reserves. Then, as a result, wall tension will occur.

Details of Flow in Zone II

Considering a particle in Zone II at a point B intermediate the punch and die in a toroidal coordinate system with the center or origin 0, two coordinates are given by the radial distance $r$ and angular coordinate $\Theta$. In a direction perpendicular to the plane of FIG. 1, there exists symmetry with respect to the angular direction around the axis of symmetry of the can.

Since any particle in Zone II moves towards the center 0, the velocity vector is $$v = -v_f r_f \cos\Theta / r \qquad 9$$

The minus sign in Eq. (9) results from the fact that according to the notation used here, the velocity $v$ directed toward the center 0 is a negative value, but the downwardly directed velocities $v_f$ and $\dot{U}$ are positive values.

Whereas in Zone I a particle moves at the constant speed $v_o$ in the axial direction, such particle when passing the surface $\tau_1$ and commencing its flow towards the apex $\tau$, will undergo a drastic change in direction and magnitude of speed. Volume constancy is maintained. There is continuity of the component of velocity normal to $\tau_1$ during passage from Zone I to Zone II across the surface $\tau_1$, but a discontinuity in flow, parallel to the direction of surface $\tau_1$, occurs. For this reason, surface $\tau_1$ is called a surface of velocity discontinuity. Continuing along the radial direction toward the apex 0, the velocity of the material particle increases at inverse proportion to its radial distance $r$. It should be noted that the velocity will change from particle to particle in accordance with the respective angular position $\Theta$. The larger $\Theta$, the slower the flow. Further, the angle $\Theta$ of any particle remains constant throughout the flow through Zone II. This is due to the fact that the flow is radial.

As the speeding material particle reaches the surface $\tau_2$ which is again a surface of velocity discontinuity, it undergoes another drastic change in flow direction and magnitude of velocity. Passing surface $\tau_2$, the particle resumes an axial flow at the constant speed $v_f$.

As stated, at the neutral point the velocity of a particle on the inner surface of the can is equal to the punch velocity $\dot{U}$. Mathematically expressed:

$$v \Big|_{\substack{r = r_N \\ \theta = 0}} = -\dot{U} \qquad (10)$$

Eq. (9) may be modified to read $$\frac{v}{v_f} = -\frac{r_f}{r}\cos\theta \qquad (11a)$$

At the interface between the workpiece and the punch, $\Theta = 0$ so that Eq. (11$a$) is reduced to $$\frac{v}{v_f} = -\frac{r_f}{r} \qquad (11b)$$

or $$v = -v_f \frac{r_f}{r} \qquad (11c)$$

Eq. (11$b$) applied to the neutral point reads:

$$\frac{\dot{U}}{v_f} = \frac{r_f}{r_N} \qquad (12)$$

or $$\frac{v_f}{\dot{U}} = \frac{r_N}{r_f} \qquad (13)$$

or $$\dot{U} = \frac{r_f}{r_N} v_f \qquad (14)$$

As indicated hereinbefore, only when $r_N$ equals $r_f$ will the exit velocity of the workpiece be equal to the punch velocity $\dot{U}$. When the position of the neutral point fluctuates and $r_N$ becomes larger, forward slip will start and may gradually become more pronounced.

Basic Power Requirements

When drawing solid material in the form of strip, front pull stress is determined by Eq. (14.16) on page 405 of the book referred to. This equation is applicable to the ironing of hollow workpieces in a slightly modified form if, preliminarily, friction at the punch is assumed to be zero. When multiplying both sides of the modified equation by the area under stress (approximated as $2\pi R_i t_f$ for $R_i$ not much smaller than $R_f$) and by the exit velocity $v_f$, the power $J_o$ (J at zero punch friction) is obtained:

$$J_o = 2\pi R_i t_f v_f \cdot \frac{2}{\sqrt{3}}\sigma_o \left\{ \frac{E(\alpha, \sqrt{3/2})}{\sin\alpha} \ln \frac{t_o}{t_f} + \frac{1-\cos\alpha}{\sin\alpha} + \frac{m_1}{2}\left(\cot\alpha \ln \frac{t_o}{t_f} + \frac{L}{t_f}\right) + \frac{\sigma_{xb}}{(2/\sqrt{3})\sigma_o} \right\} \qquad (15)$$

Friction losses over the interface between punch and can will be computed next. From surface $\tau_1$ to point N, punch speed is higher than speed of the can, and in view of Eqs. (11$c$) and (12) the relative velocity between punch and can, i.e., the difference in velocity, is in this region:

$$\Delta v = \dot{U} + v = \dot{U} - v_f \frac{r_f}{r} = \left(\frac{\dot{U}}{v_f} - \frac{r_f}{r}\right) v_f = \left(\frac{r_f}{r_N} - \frac{r_f}{r}\right) v_f \qquad (16)$$

From $r_N$ to $r_f$ the can material moves at the interface faster than the punch so that, with the aid of Eq. (14), $$\Delta v = -v - \dot{U} = \left(\frac{r_f}{r} - \frac{r_f}{r_N}\right) v_f \qquad (17)$$

From the surface $\tau_2$ on downward, the relative speed is constant at $$\Delta v = v_f - \dot{U} = \left(1 - \frac{r_f}{r_N}\right) v_f \qquad (18)$$

The length $L_R$ (FIG. 1) of the area of contact between punch and can below $\tau_2$ where friction is still relevant, is estimated at $$L_R = r_f - r_f \cos\alpha + L = (1 - \cos\alpha + (L/r_f)\ \ r_f \qquad (19)$$

Friction losses occurring over the interface between punch and can and caused by shear stresses will be designated $\dot{W}_S$ which symbol indicates work per unit of time under shear. Based on Eq. (5.23) on page 59 of the book referred to, these friction losses can be computed as follows:

$$\dot{W}_S = 2\pi R_i m_2 \frac{\sigma_o}{\sqrt{3}} \int |(v + \dot{U})|\, dr$$

$$= 2\pi R_i v_f m_2 \frac{\sigma_o}{\sqrt{3}} \left\{ -\int_{r=r_o}^{r_N} \left(\frac{r_f}{r_N} - \frac{r_f}{r}\right) dr - \int_{r=r_N}^{r_f} \left(\frac{r_f}{r} - \frac{r_f}{r_N}\right) dr \right. \qquad (20a)$$

$$\left. + \left(1 - \frac{r_f}{r_N}\right) \left(1 - \cos\alpha + \frac{L}{r_f}\right) r_f \right\}$$

or $$\dot{W}_S = 2\pi R_i v_f m_2 \frac{\sigma_o}{\sqrt{3}} \left\{ \frac{r_f}{r_N}(r_o - r_N) + r_f \ln \frac{r_N}{r_o} - r_f \ln \frac{rf}{r_N} + \frac{r_f}{r_N}(r_f - r_N) \right. \qquad (20b)$$

$$\left. + \left(1 - \frac{r_f}{r_N}\right) \left(1 - \cos\alpha + \frac{L}{r_f}\right) r_f \right\}$$

Eq. (20*b*) may be rearranged as follows:

$$\dot{W}_S = 2\pi R_i v_f r_f m_2 \frac{\sigma_o}{\sqrt{3}} \left\{ \frac{r_o}{r_N} - 1 - \ln \frac{r_o}{r_N} + \ln \frac{r_N}{r_f} + \frac{r_f}{r_N} - 1 \right. \qquad (20c)$$

$$\left. + \left(1 - \frac{r_f}{r_N}\right) \left(1 - \cos\alpha + \frac{L}{r_f}\right) \right\}$$

As will be apparent from FIG. 1, the parameters $r_o$, $r_f$ are geometrically related to $t_o$, $t_f$, respectively:

$$r_o = t_o/\sin\alpha \qquad 21a$$

$$r_f = t_f/\sin\alpha \qquad 21b$$

Considering the parameter $r_N$, Eq. (14) may be modified as follows:

$$r_N/r_f = v_f/\dot{U} \qquad 21c$$

Upon multiplication with $r_f/r_o$, Eq. (21*c*) becomes $$r_N/r_o = (r_f/r_o)(v_f/\dot{U}) = (t_f/t_o)(v_f/\dot{U}) \qquad 21d$$

Accoraingly, Eq. (20*c*) for friction power losses over the interface between the punch and the can may be modified to read $$\dot{W}_S = 2\pi R_i v_f \frac{t_f}{\sin\alpha} m_2 \frac{\sigma_o}{3} \left\{ \frac{t_o}{t_f} \cdot \frac{\dot{U}}{v_f} - 1 - \ln \left(\frac{t_o}{t_f} \cdot \frac{\dot{U}}{v_f}\right) + \ln \frac{v_f}{\dot{U}} \right. \qquad (22a)$$

$$\left. + \frac{\dot{U}}{v_f} - 1 + \left(1 - \frac{\dot{U}}{v_f}\right) \left(1 - \cos\alpha + \frac{L}{t_f} \sin\alpha\right) \right\}$$

When rearranged, Eq. (22*a*) becomes $$\dot{W}_S = 2\pi R_i \frac{v_f t_f}{\sin\alpha} m_2 \frac{\sigma_o}{\sqrt{3}} \left\{ \frac{t_o}{t_f} \cdot \frac{\dot{U}}{v_f} - 1 - \ln \frac{t_o}{t_f} + 2\ln \frac{v_f}{\dot{U}} + \frac{\dot{U}}{v_f} - 1 \right. \qquad (22b)$$

$$\left. + 1 - \frac{\dot{U}}{v_f} + \left(1 - \frac{\dot{U}}{v_f}\right) \left(-\cos\alpha + \frac{L}{t_f} \sin\alpha\right) \right\}$$

Eq. (22*b*) may be reduced to $$\dot{W}_S = 2\pi R_i \frac{v_f t_f}{\sin\alpha} m_2 \frac{\sigma_o}{\sqrt{3}} \left\{ -\left(1 + \ln \frac{t_o}{t_f}\right) + 2\ln \frac{v_f}{\dot{U}} + \frac{t_o}{t_f} \frac{\dot{U}}{v_f} \right. \qquad (22c)$$

$$\left. + \left(1 - \frac{U}{v_f}\right) \left(-\cos\alpha + \frac{L}{t_f} \sin\alpha\right) \right\}$$

Adding punch friction losses by Eq. (22c) to the power $J_o$ presented by Eq. (15), the required total power J* becomes:

$$J = J_o + \dot{W}_S = 2\pi R_i t_f \frac{v_f}{\dot{U}} \dot{U} \frac{2}{\sqrt{3}} \sigma_o \left\{ \frac{E(\alpha, \sqrt{3}/2)}{\sin\alpha} \ln \frac{t_o}{t_f} + \frac{1-\cos\alpha}{\sin\alpha} + \frac{m_1}{2\sin\alpha} \left( (\cos\alpha) \ln \frac{t_o}{t_f} + \frac{L}{t_f} \sin\alpha \right) + \frac{\sigma_{xb}}{\frac{2}{\sqrt{3}}\sigma_o} + \frac{m_2}{2\sin\alpha} \left[ 2\ln \frac{v_f}{\dot{U}} + \frac{t_o}{t_f} \cdot \frac{\dot{U}}{v_f} - 1 - \ln \frac{t_o}{t_f} + \left(1 - \frac{\dot{U}}{v_f}\right) \left( -\cos\alpha + \frac{L}{t_f} \sin\alpha \right) \right] \right\} \quad (23a)$$

Symbolically $$J^* = 2\pi R_i t_f \dot{U} \frac{2}{\sqrt{3}} \sigma_o f \left( \alpha, \frac{t_o}{t_f}, \frac{L}{tf}, \frac{\sigma_{xb}}{\frac{2}{\sqrt{3}}\sigma_o}, m_1, m_2 \text{ and } \frac{v_f}{\dot{U}} \right) \quad (23b)$$

where $V_f/\dot{U}$ is a pseudo-independent process parameter.

Dividing both sides of Eq. (23a) by $2\pi R_i t_f \dot{U}(2/\sqrt{3})\sigma_o$, the weighted power becomes:

$$j^* = \frac{v_f}{\dot{U}} \left\{ \frac{E(\alpha, \sqrt{3}/2)}{\sin\alpha} \ln \frac{t_o}{t_f} + \frac{1-\cos\alpha}{\sin\alpha} + \frac{m_1}{2\sin\alpha} \left[ (\cos\alpha) \ln \frac{t_o}{t_f} + \frac{L}{t_f} \sin\alpha \right] + \frac{\sigma_{xb}}{\frac{2}{\sqrt{3}}\sigma_o} + \frac{m_2}{2\sin\alpha} \left[ 2\ln \frac{v_f}{\dot{U}} + \frac{t_o/t_f}{v_f/\dot{U}} - 1 - \ln \frac{t_o}{t_f} + \left(1 - \frac{1}{v_f/\dot{U}}\right) \left( -\cos\alpha + \frac{L}{t_f} \sin\alpha \right) \right] \right\}, \quad (24a)$$

which symbolically is presented as $$j^* = f \left( \alpha, \frac{t_o}{t_f}, \frac{L}{t_f}, \frac{\sigma_{xb}}{\frac{2}{\sqrt{3}}\sigma_o}, m_1, m_2 \text{ and } \frac{v_f}{\dot{U}} \right) \quad (24b)$$

The characteristics of Eq. (24a) are presented in FIG. 4. The abscissa is the forward slip, and the ordinate is the weighted power consumption. Reduction ratio $t_o/_f$ is a parameter while die angle, punch friction and die friction values are held constant, and $\sigma_{xb}$ and L are zero. Each characteristic line exhibits a minimum for some value of forward slip. It has been found that the actual value of forward slip occurring during ironing tends to coincide with the value of forward slip that minimizes the power consumption. Thus an optimal value of forward slip may be obtained through the process of minimization of power as explained later. While any value of $v_f/\dot{U}$ is kinematically admissible, flow in nature tends to occur under that mode which minimizes the required power.

Figure 4:
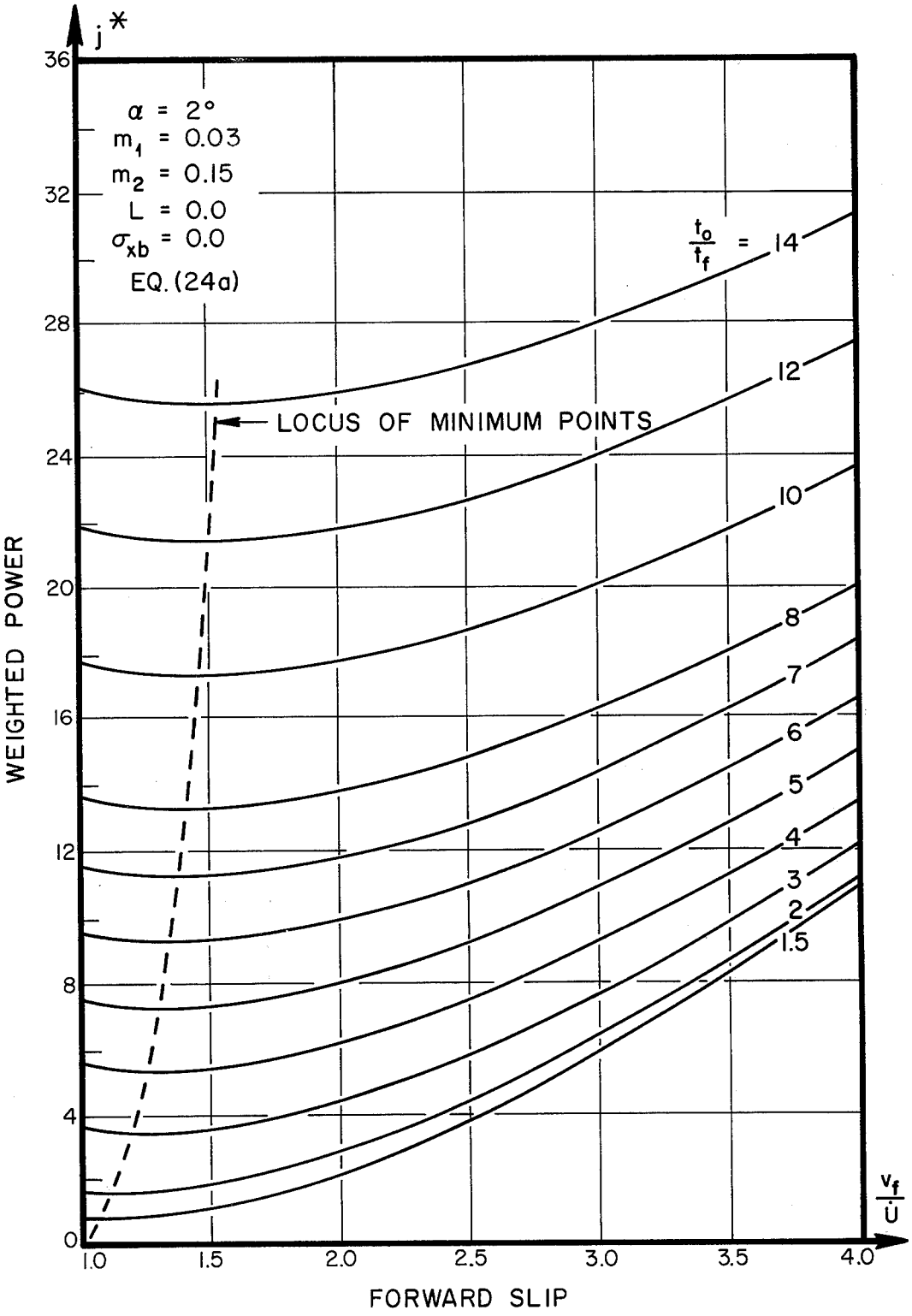

It should be noted from FIG. 4 that forward slip (the minimum point) increases with increasing reductions.

Minimization of Power

Each minimum point in Eq. (24a) can be found by the following differentiation $$\frac{\delta j^*}{\delta(v_f/\dot{U})} = 0 \quad (25)$$

Thus, the amount of forward slip which minimizes power consumption can be found by differentiation of Eq. (24a) according to Eq. (25). The result is:

$$\frac{v_f}{\dot{U}} \left\{ \frac{E(\alpha, \sqrt{3}/2)}{\sin\alpha} \ln \frac{t_o}{t_f} + \frac{1-\cos\alpha}{\sin\alpha} + \frac{\sigma_{xb}}{\frac{2}{\sqrt{3}}\sigma_o} + \frac{m_1}{2\sin\alpha} \left[ \cos\alpha \ln \frac{t_o}{t_f} + \frac{L}{t_f} \sin\alpha \right] + \frac{m_2}{2\sin\alpha} \left[ 1 - \ln \frac{t_o}{t_f} - \cos\alpha + \frac{L}{t_f} \sin\alpha + 2\ln \frac{v_f}{\dot{U}} \right] \right\} = 0 \quad (26)$$

One solution of Eq. (26) is $$V_f/\dot{U} = 0 \quad 27$$

This solution would be feasible only when the workpiece stalls and no ironing is performed. In the case of tube drawing, this situation may occur and suitable means to avoid it are to be provided. In can ironing, physically, the can having a bottom cannot normally leave the die more slowly than the punch and Eq. (27)

would prevail only when bottom or wall tearing occurs. It should also be noted that Eq. (26) is valid only when $v_f > \dot{U}$, thus the solution by Eq. (27) does not apply here.

The other solution of Eq. (26) will provide the optimal value of $v_f/\dot{U}$ when the term in braces is made equal to zero. Solving explicitly for $v_f/\dot{U}$, the result can be presented in two ways:

$$\frac{v_f}{\dot{U}} = \mathrm{EXP}\left\{-\frac{\sin\alpha}{m_2}\left[\frac{E(\alpha,\sqrt{3}/2)}{\sin\alpha}\ln\frac{t_o}{t_f} + \frac{1-\cos\alpha}{\sin\alpha} + \frac{\sigma_{xb}}{\frac{2}{\sqrt{3}}\sigma_o} + \frac{m_1}{2\sin\alpha}\left(\cos\alpha\ln\frac{t_o}{t_f} + \frac{L}{t_f}\sin\alpha\right) + \frac{m_2}{2\sin\alpha}\left(1 - \ln\frac{t_o}{t_f} - \cos\alpha + \frac{L}{t_f}\sin\alpha\right)\right]\right\} \quad (28a)$$

or $$\frac{v_f}{\dot{U}} = \left(\frac{t_o}{t_f}\right)^{\left[\frac{1}{2}\left(1-\frac{m_1}{m_2}\cos\alpha\right) - \frac{E(\alpha,\sqrt{3}/2)}{m_2}\right]} \times \mathrm{EXP}\left\{-\left[\frac{1-\cos\alpha}{m_2} + \frac{\sin\alpha}{m_2}\,\frac{\sigma_{xb}}{\frac{2}{\sqrt{3}}\sigma_o} + \frac{1}{2}\,\frac{m_1}{m_2}\,\frac{L}{t_f}\sin\alpha + \frac{1}{2}\left(1-\cos\alpha+\frac{L}{t_f}\sin\alpha\right)\right]\right\} \quad (28b)$$

Both Eqs. (28*a*) and (28*b*) which are different in form are identical expressions of the same mathematical relations that can be represented symbolically by $$\frac{v_f}{\dot{U}} = f\left(\frac{t_o}{t_f}, \alpha, \frac{L}{t_f}, \frac{\sigma_{xb}}{\frac{2}{\sqrt{3}}\sigma_o}, m_1, m_2\right) \quad (28c)$$

Characteristics of Eqs. (28*a*, *b*)

Equation (28*b*) clearly indicates the relation between $v_f/\dot{U}$ and $t_o/t_f$ for fixed die angle and friction values. The exponential expression in the last part of Eq. (28*b*) is always a value smaller than one, while the power expression of $t_o/t_f$ in the first part of Eq. (28*b*) becomes small and approaches one when $t_o/t_f$ is small and approaches one. Under such conditions $v_f/\dot{U}$ may be smaller than one so that there would be no forward slip. It is, therefore, clear that when very small reductions are attempted, forward slip cannot prevail. For forward slip, reduction must be of a certain value or above, that is, forward slip and the concept of unlimited reduction prevail only when the exponent of $t_o/t_f$ in Eq. (28*b*) is above zero, a condition that is obtained when expression (3) applies.

Figure 5:
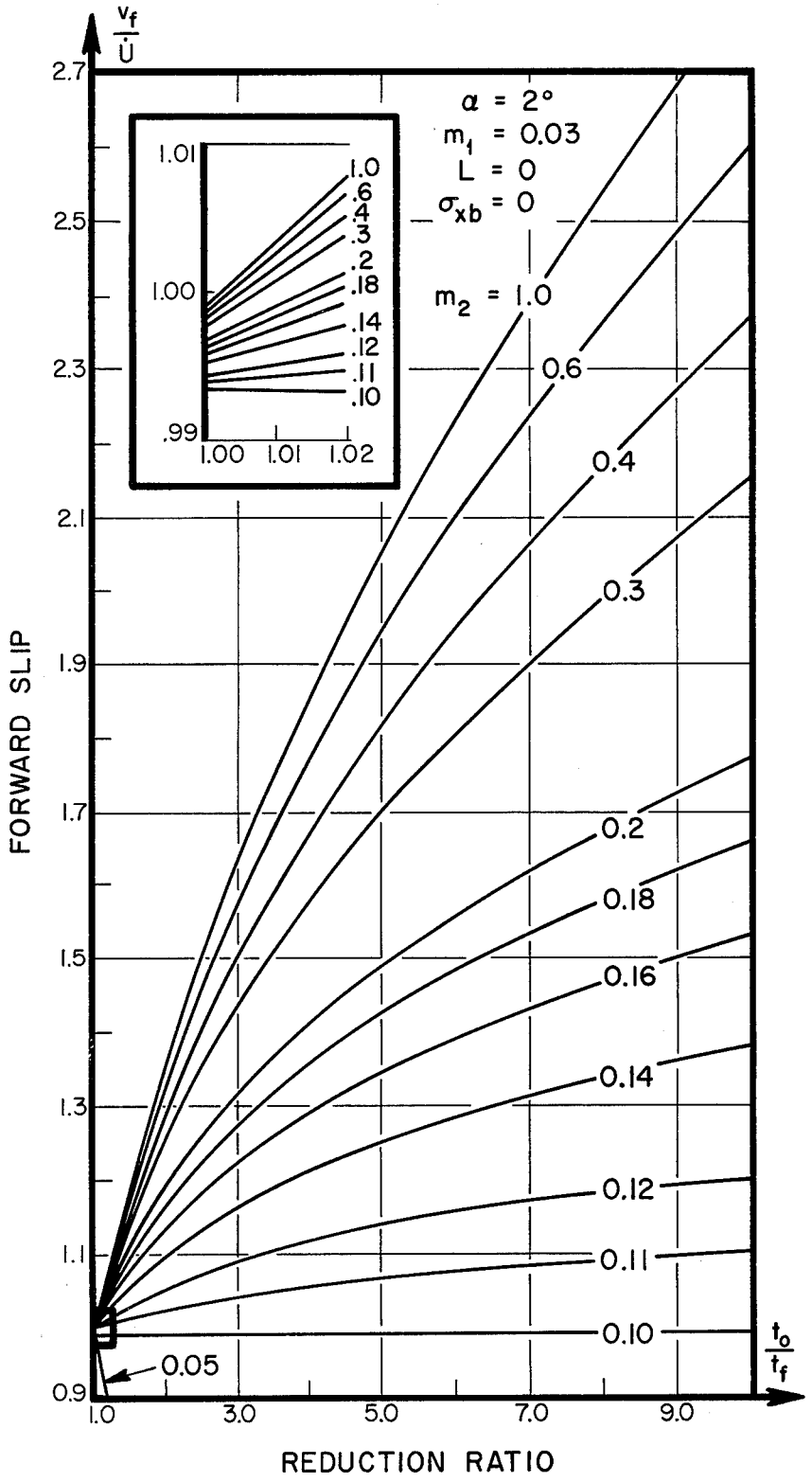

The characteristics of Eqs. (28*a*, *b*) are presented graphically in FIGS. 5 to 10 in which the ordinate is the forward slip or relative forward speed $v_f/\dot{U}$. In FIG. 5, the abscissa is the reduction ratio $t_o/t_f$ and the parameter is the punch friction $m_2$. The die angle, die friction, land, and back tension are all kept constant at: $\alpha = 2°$, $m_1 = 0.03$, L = 0 and $\sigma_{xb} = 0$, respectively. There is a monotonous increase in forward slip with increase in reduction ratio and in punch friction. The insert near the upper left corner of FIG. 5 is a large scale illustration of the area adjacent $t_o/t_f = 1$ and $v_f/\dot{U} = 1$, and here again it should be noted that forward slip occurs only when finite reduction is effected and not below a critical value, depending upon the magnitude of punch friction. When a can with a bottom is made or when tube ironing is effected by pulling a tube and mandrel, reduction below the critical value would introduce wall tension. However, when tube ironing is effected by pulling the mandrel alone, the tube will stop moving if reduction is below the critical value.

Figure 6:
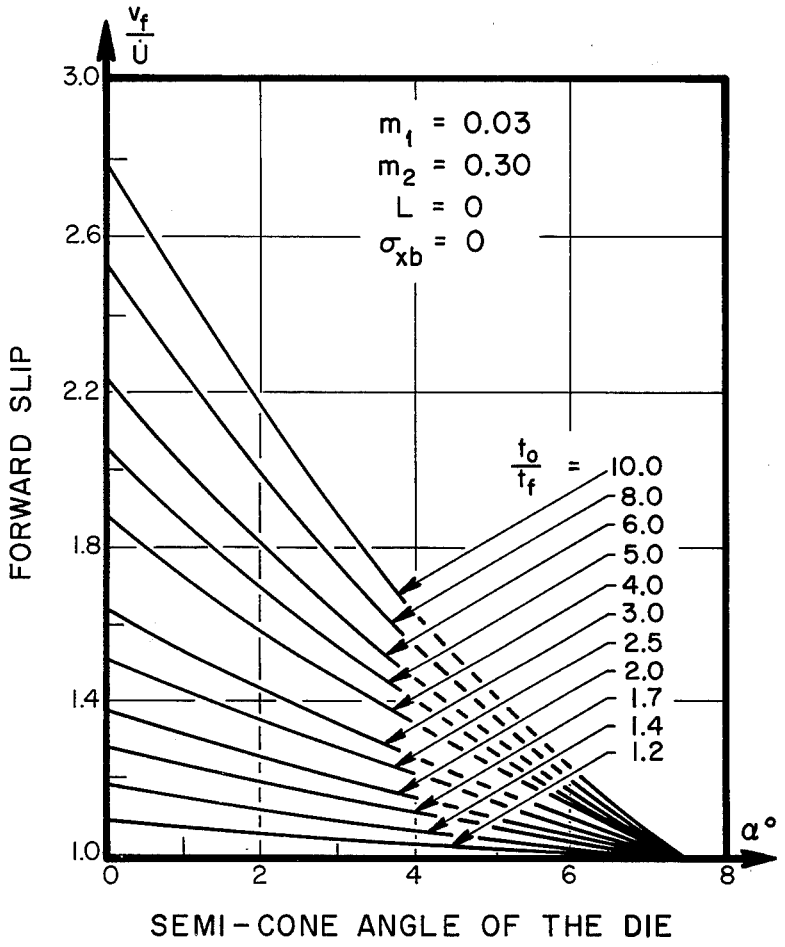

In FIG. 6, the abscissa is the semi-cone angle of the die, and the parameter is the reduction ratio. Punch and die frictions are $m_2 = 0.3$ and $m_1 = 0.03$, respectively, while the land and back tension are both zero. There is monotonous decrease in relative forward speed or slip with increase in die angle and decrease in reduction. The intersection with the abscissa at various critical die angle values is evident. If the respective critical die angle is exceeded, there will be no forward slip.

Figure 7:
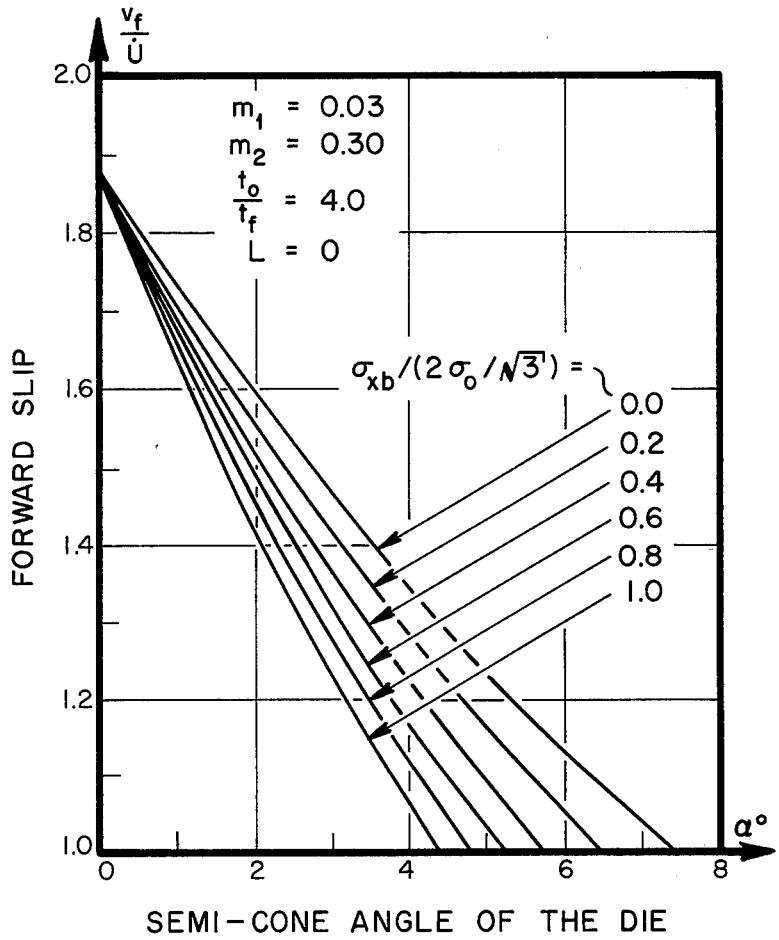
Figure 8:
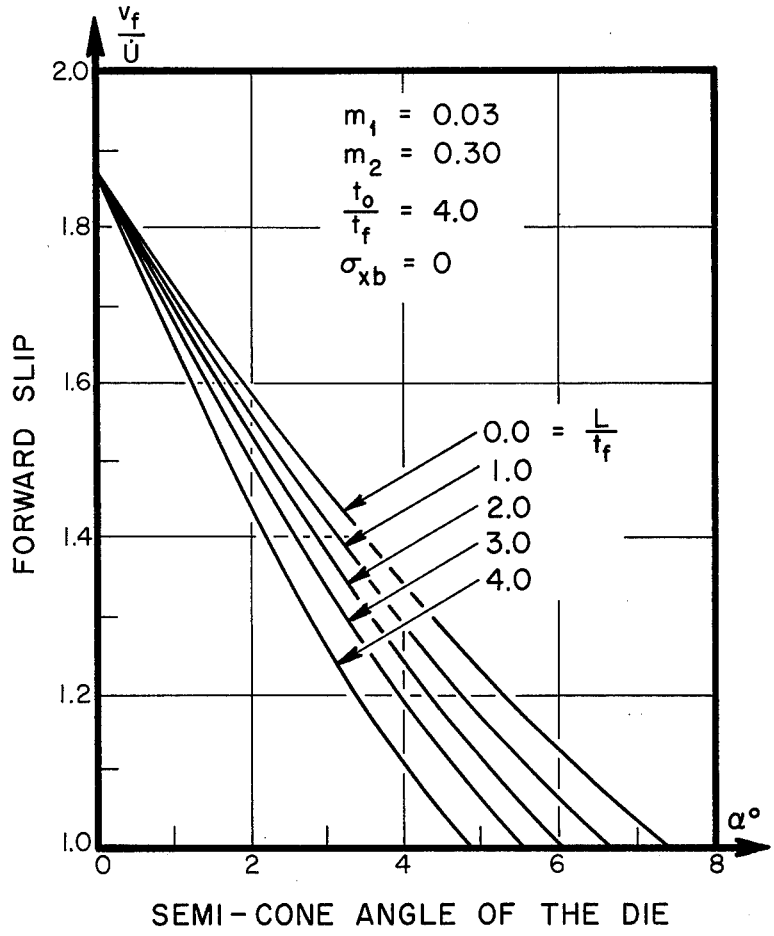

The effects of back tension, and of land, on relative forward speed or slip are studied in FIGS. 7 and 8, respectively. In both Figs. the abscissa is the semi-cone angle of the die, whereas die and punch friction, and reduction ratio are kept constant at $m_1 = 0.03$, $m_2 = 0.3$, and $t_o/t_f = 4$, respectively. In FIG. 7 the land is zero and relative back tension is the parameter while in FIG. 8 back tension is zero and relative length of the land is the parameter. There is a monotonous decrease in relative forward speed or slip with increase in die angle, in relative back tension (FIG. 7) and length of the land (FIG. 8). Here again, the abscissa is intersected at various critical die angles, and if these angles are exceeded, no forward slip prevails.

Figure 9:
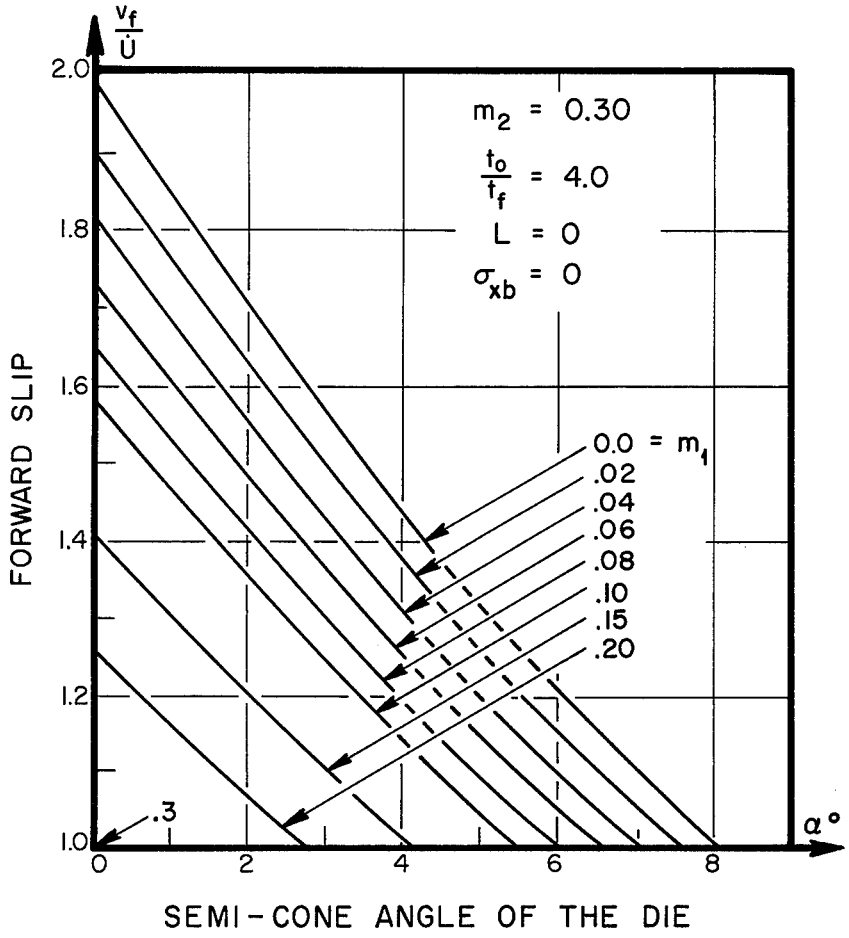
Figure 10:
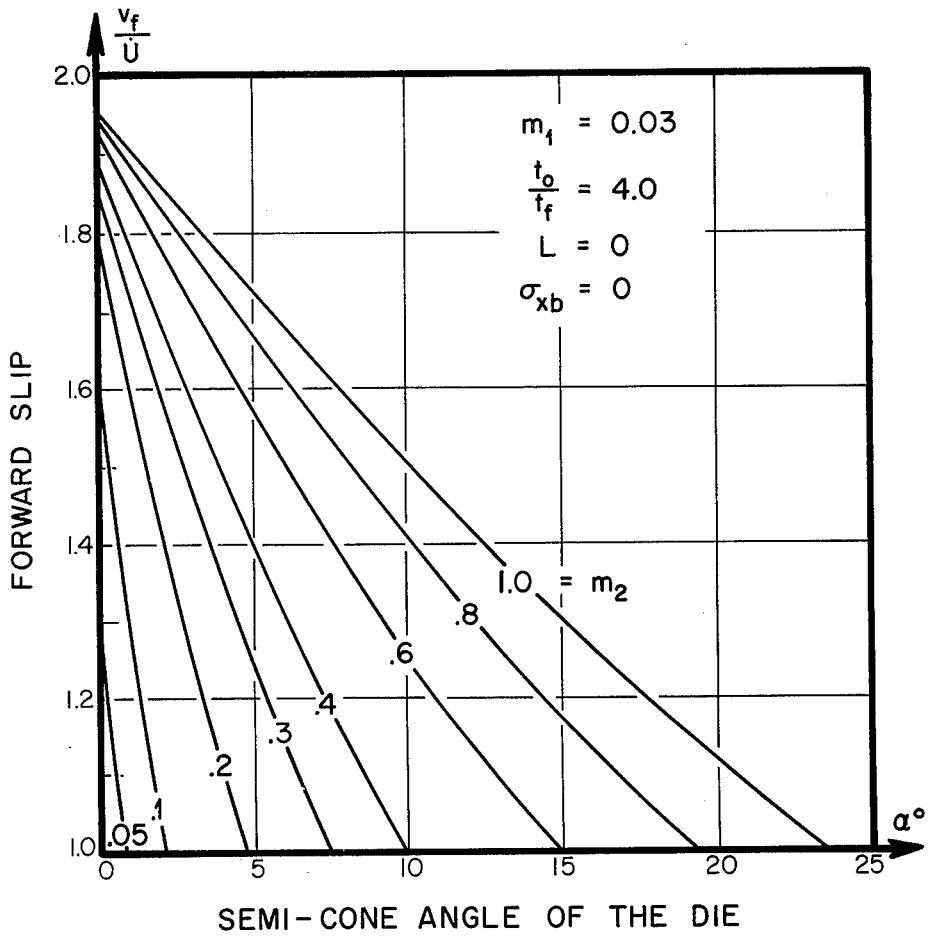

In FIGS. 9 and 10, die and punch friction are the parameters, respectively. The die angle is the abscissa in both figures, and $t_o/t_f = 4$, L = 0, and $\sigma_{xb} = 0$ are constants. In FIG. 9, $m_2$ equals 0.30, and in FIG. 10, $m_1$ equals 0.03. Decrease in die friction (FIG. 9) and increase in punch friction (FIG. 10) cause increase in forward slip.

It will be apparent from the foregoing explanations that forward slip may be controlled by suitable selection of related values such as reduction ratio, die angle, and friction factors.

Criteria for Required Minimum Reduction Ratio

The minimum reduction ratio required for forward slip may be expressed by comparison with conditions for zero forward slip.

When no forward slip occurs and thus $v_f/\dot{U}$ equals one, and when wall tension diminishes and $\sigma_{xf}$ equals zero, the term in brackets in Eq. (28*a*) becomes zero. For zero forward slip and zero wall tension, therefore, Eq. (28*a*) leads to $$\frac{t_o}{t_f} = \text{EXP}\left\{\frac{-\frac{\sigma_{xb}}{(2/\sqrt{3})\sigma_o} - \frac{1-\cos\alpha}{\sin\alpha} - \frac{m_1}{2}\frac{L}{t_f} - \frac{m_2}{2\sin\alpha}\left(1-\cos\alpha+\frac{L}{t_f}\sin\alpha\right)}{\frac{E(\alpha,\sqrt{3}/2)}{\sin\alpha} + \frac{m_1}{2}\cot\alpha - \frac{m_2}{2\sin\alpha}}\right\} \quad (29)$$

In Eq. (29), provision is made for friction between punch and can beyond the exit from the conical portion of the die, whereas such friction is not included in Eq. (1*a*).

To obtain forward slip, the reduction ratio should be larger than the value indicated by Eq. (29).

Reduction Ratio vs. Forward Slip as Parameter

Equating the term in braces in Eq. (26) to zero, and rearranging the equation, leads to an explicit expression for $t_o/t_f$ as a function of the other process variables, including forward slip. The expression reads:

$$\frac{t_o}{t_f} = \text{EXP}\left\{\frac{-\frac{\sigma_{xb}}{(2/\sqrt{3})\sigma_o} - \frac{1-\cos\alpha}{\sin\alpha} - \frac{m_1}{2}\cdot\frac{L}{t_f} - \frac{m_2}{2\sin\alpha}\left(1-\cos\alpha+\frac{L}{t_f}\sin\alpha+2\ln\frac{v_f}{\dot{U}}\right)}{\frac{E(\alpha,\sqrt{3}/2)}{\sin\alpha} + \frac{m_1}{2}\cot\alpha - \frac{m_2}{2\sin\alpha}}\right\} \quad (30a)$$

It may be noted that when $v_f/\dot{U} = 1$, the present equation is reduced to become Eq. (29).

An explicit expression for $t_o/t_f$ as a function of the other process variables can be found also by rearranging Eq. (28*b*) to read:

$$\frac{t_o}{t_f} = \left(\frac{v_f}{\dot{U}}\right)^{\left\{1/\left[\frac{1}{2}\left(1-\frac{m_1}{m_2}\cos\alpha\right)-\frac{E(\alpha,\sqrt{3}/2)}{m_2}\right]\right\}} \times \text{EXP}\left\{\frac{\frac{1-\cos\alpha}{m_2} + \frac{\sin\alpha}{m_2}\frac{\sigma_{xb}}{(2/\sqrt{3})\sigma_o} + \frac{1}{2}\frac{m_1}{m_2}\frac{L}{t_f}\sin\alpha + \frac{1}{2}\left(1-\cos\alpha+\frac{L}{t_f}\sin\alpha\right)}{\frac{1}{2}\left(1-\frac{m_1}{m_2}\cos\alpha\right)-\frac{E(\alpha,\sqrt{3}/2)}{m_2}}\right\} \quad (30b)$$

While different in appearance, both Eqs. (30*a*, *b*) are identical and may be represented symbolically by $$\frac{t_o}{t_f} = f\left(\alpha, m_1, m_2, \frac{L}{t_f}, \frac{\sigma_{xb}}{\frac{2}{\sqrt{3}}\sigma_o}, \text{and } \frac{v_f}{\dot{U}}\right) \quad (30c)$$

Figure 11:
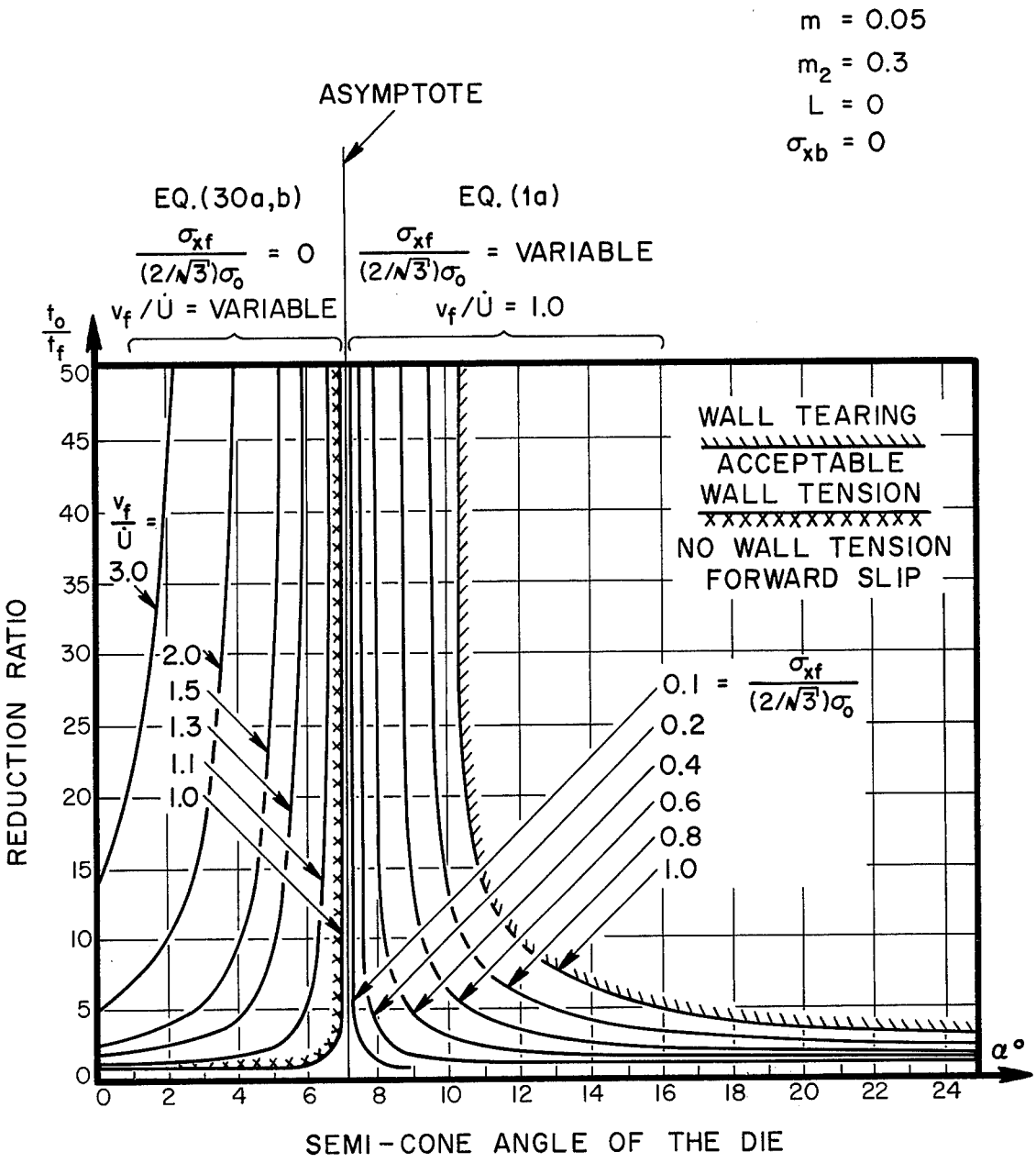

Referring now to FIG. 11, the diagram shown is in part based on FIG. 2, but is drawn on a larger scale. The abscissa is the semi-cone angle of the die while the ordinate is the reduction ratio. Constants are $m_1 = 0.05$, $m_2 = 0.3$, $L = 0$, and $\sigma_{xb} = 0$.

Characteristics of Eqs. (30*a*, *b*) are shown in the portion of FIG. 11 to the left of the curve marked by crossed strokes, where the solution with forward slip and zero wall tension prevails. Forward slip is the variable parameter here. To achieve higher and higher values of forward slip, higher reduction ratios are needed. Values of $t_o/t_f$ required to achieve a desired amount of forward slip become smaller when smaller die angles are used.

The right-hand portion of FIG. 11 substantially corresponds to the diagram of FIG. 2 and thus represents ironing with wall tension, the latter being the variable parameter in this portion of the diagram.

Stripping

In the past, stripping has been started with the mandrel and workpiece being at rest relative to each other, and in tight contact with each other due to pressure exerted during the preceding ironing operation. As is well known, starting friction is much higher than sliding friction and, therefore, a force of great magnitude is required to initiate the stripping operation in the conventional manner. Once the stripping has started, a much smaller force is sufficient to continue the motion.

According to the invention, at least a partial stripping force is applied to the workpiece while forward slip still exists. Thus, forward motion relative to the mandrel will be maintained. As a result, stripping will no longer start from a rest position of the workpiece, and the previously required high initial force will be avoided.

Figure 12:
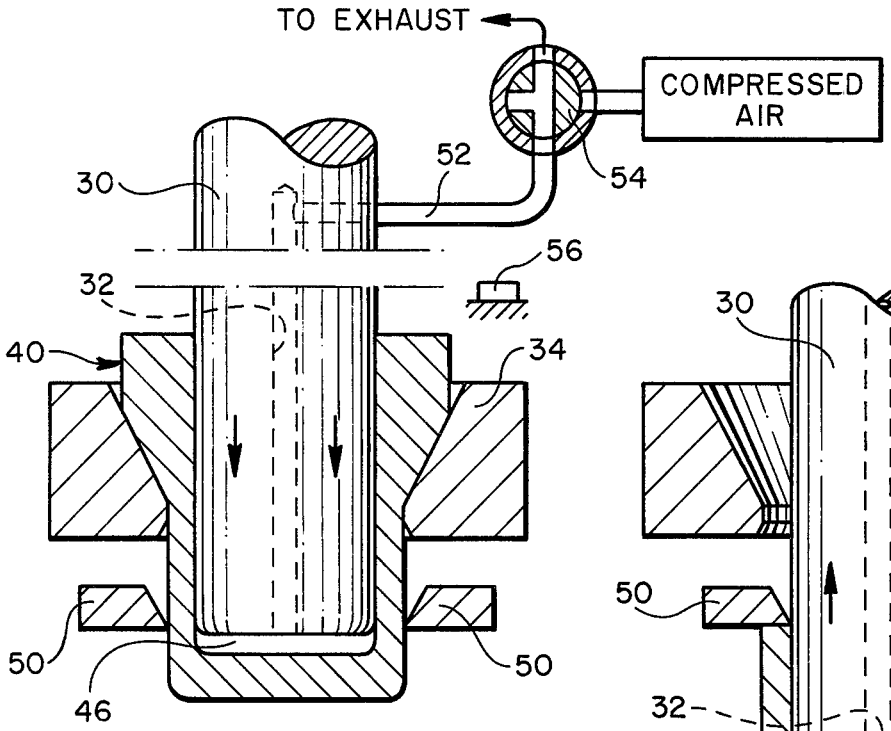
FIGS. 12 and 13 illustrate the stripping of a workpiece in accordance with the invention.
Figure 13:
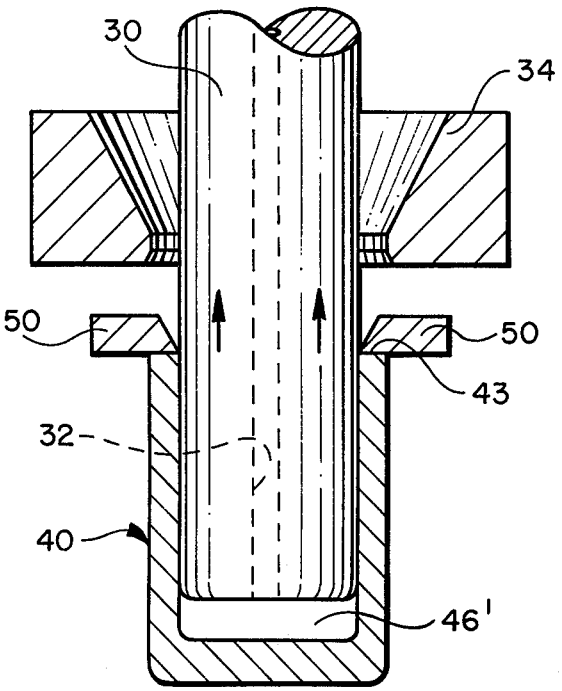

FIGS. 12 and 13 illustrate the improved procedure in connection with conventional mechanical stripping means which are here shown as movable stripper fingers 50 located underneath the ironing die 34 and biased in the direction toward the axis of symmetry. When mandrel 30 and workpiece or can 40 advance downwards, the fingers 50 are pushed outwardly to clear the path of the can as indicated in FIG. 12.

Bore 32 of the mandrel is connectible to a source of fluid under pressure such as compressed air, through a hose 52 and a 3-way valve 54. Heretofore, such compressed air has been used to assist in overcoming high friction when starting to strip from a rest position. According to the improved method, valve 54 will be actuated by means of a limit switch 56 or the like when the can is about to leave the die. The limit switch may be operated by an element (not shown) adjustably connected to ram 33 (FIG. 1). Upon proper adjustment, compressed air will be admitted through bore 32 to gap 46 previously formed due to forward slip of the can. The air pressure should be such as to maintain slipping motion of the can relative to the mandrel. An air pressure of about 35 psi. has been found sufficient for this purpose in various instances.

When the position shown in FIG. 13 is reached, the gap will have increased as indicated at 46', and tends to become still larger due to the action of the air pressure.

The stripper fingers 50 have moved inwardly to engage the rear face 43 of the can. When now mandrel 30 is reversed, the fingers 50 will retain the can in generally conventional manner to complete the stripping, but only a limited punch force will be required since merely sliding friction has to be overcome, instead of starting friction.

Figure 14:
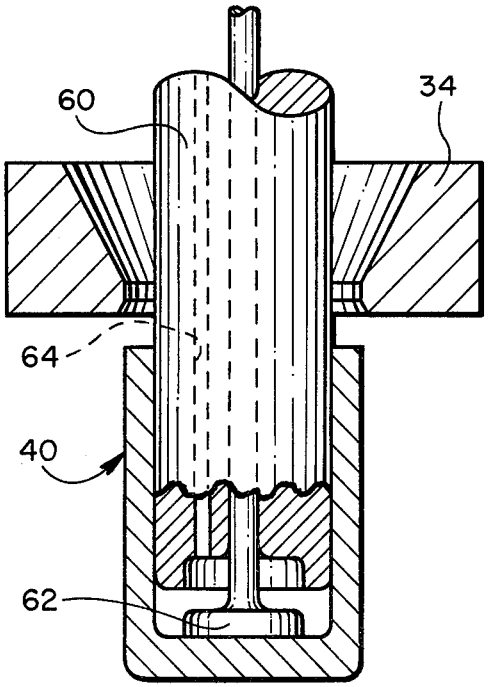
FIG. 14 illustrates a modification of the stripping arrangement.

FIG. 14 shows a modification in which a mandrel or punch 60 is equipped with a conventional auxiliary knock-out punch 62. Heretofore, such auxiliary punch had to overcome high starting friction when actuated to strip the workpiece from the mandrel. In the improved method, compressed air will be introduced through bore 64 into can 40 at the time the can is about to leave die 34 generally as described in connection with FIG. 12 so that forward slip will be prevented from fizzling out. When the can has completely emerged from the die and the auxiliary punch is actuated, only sliding friction need be overcome. Forward slip and final stripping movement will blend with each other, whereby a continuous motion will be obtained until the stripping has been completed.

If the conditions are favorable, compressed air alone may be used to carry out the entire stripping operation as a continuation of forward slip motion. It has been found that in certain cases, an air pressure of about 50 psi will be sufficient to cause the can to move off the mandrel without the use of a conventional stripper.

The procedure described may be modified so as to apply air pressure approximately at the start of the ironing operation or soon after ironing has commenced. Any wall tension caused by air pressure of the magnitude needed for stripping would be entirely insignificant.

Instead of using fluid pressure in the interior of the workpiece, means engaging the outer surface thereof may be exployed to maintain forward slip. For example, power-driven rolls may be actuated and caused to engage the outside of the workpiece at the time the latter is about to leave the die. Such arrangement is suitable in particular when ironing workpieces without bottom, such as tubes, and will again render it possible to blend forward slip and stripping movement.

As stated hereinbefore, back pull stress may be present, e.g., when deep drawing and ironing are combined, in which case $\sigma_{xb}$ is a positive value. Instead thereof, back push stress may occur when ironing is facilitated by the application of a force to the end face 43 (FIG. 1) of the workpiece. Such force will exert extruding pressure, and $\sigma_{xb}$ will then be a negative value in the foregoing equations.

While certain specific examples have been described and illustrated, it will be understood that various modifications and changes may be made without departing from the scope of the invention as defined in the appended claims. For example, the die aperture 36 may include a portion which, instead of being precisely conical, has a similar convergent shape.

What is claimed is:

1. In a method of making a hollow workpiece with the aid of a punch and a die having an aperture extending therethrough; the steps of providing said workpiece with a side wall; causing said punch to engage the interior of said hollow workpiece so that the latter is positioned on said punch; causing movement of said punch with said workpiece thereon relative to said die and into said aperture thereof at an operational speed to iron said workpiece and thereby reduce the thickness and increase the length of said side wall while subjecting said workpiece to a relatively large frictional force at said punch, and a smaller frictional force at said die; forcing said workpiece to leave said die at a speed exceeding said operational speed of the punch so as to cause forward slip of the ironed portion of said workpiece with respect to said punch; and controlling said forward slip of the ironed portion.

2. In a method of making a hollow workpiece with the aid of a punch and a die having an aperture extending therethrough, said aperture including a substantially conical portion having a semi-cone angle $\alpha$ and a substantially cylindrical portion adjacent to said conical portion; the steps of providing said workpiece with a side wall; causing said punch to engage the interior of said hollow workpiece so that the latter is positioned on said punch; causing movement of said punch with said workpiece thereon relative to said die and into said aperture thereof to iron said workpiece and thereby reduce the thickness and increase the length of said side wall while subjecting said workpiece to a relatively large frictional force at said punch, and a smaller frictional force at said die; and forcing said workpiece to leave said die faster than said punch so as to cause forward slip of the ironed portion of said workpiece with respect to said punch, the reduction in thickness of said side wall exceeding the value resulting from the equation $$\frac{t_o}{t_f} = \mathrm{EXP}\left\{\frac{\dfrac{-\sigma_{xb}}{(2/\sqrt{3})\sigma_o} - \dfrac{1-\cos\alpha}{\sin\alpha} - \dfrac{m_1}{2}}{\dfrac{E(\alpha, \sqrt{3}/2)}{\sin\alpha} + \dfrac{m_1}{2}\cot\alpha - \dfrac{\dfrac{L}{t_f} - \dfrac{m_2}{2\sin\alpha}\left(1-\cos\alpha + \dfrac{L}{t_f}\sin\alpha\right)}{\dfrac{m_2}{2\sin\alpha}}}\right\}$$

wherein $t_o$ = original thickness of side wall,
$t_f$ = final thickness of side wall,
Exp = exponential function,
$\sigma_{xb}$ = back pull stress,
$\sigma_o$ = flow stress of solid rod specimen of workpiece material,
$m_1$ = die friction factor,
$m_2$ = punch friction factor,
L = length of substantially cylindrical portion of die,
E ($\alpha$, $\sqrt{3}/2$) = elliptic integral of second kind.

3. In a method of making a hollow workpiece with the aid of a punch and a die having an aperture extending therethrough, said aperture including a substantially conical portion having a semi-cone angle $\alpha$ and a substantially cylindrical portion adjacent to said conical portion; the steps of providing said workpiece with a side wall; causing said punch to engage the interior of said hollow workpiece so that the latter is positioned on said punch; causing movement of said punch with said workpiece thereon relative to said die and into said aperture thereof to iron said workpiece and thereby reduce the thickness and increase the length of said side wall while subjecting said workpiece to a relatively large frictional force at said punch, and a smaller frictional force at said die; forcing said workpiece to leave said die faster than said punch so as to cause forward slip of the ironed portion of said workpiece with respect to said punch; and controlling said forward slip in part by said semi-cone angle $\alpha$ being in agreement with the expression $$2E(\alpha, \sqrt{3}/2) + m_1 \cos\alpha - m_2 < 0$$

and said reduction in thickness being in accordance with the equation $$\frac{t_o}{t_f} = \mathrm{EXP}\left\{\frac{-\dfrac{\sigma_{xb}}{(2/\sqrt{3})\sigma_o} - \dfrac{1-\cos\alpha}{\sin\alpha} - \dfrac{m_1}{2}\cdot\dfrac{L}{t_f} - \dfrac{m_2}{2\sin\alpha}\left(1-\cos\alpha + \dfrac{L}{t_f}\sin\alpha + 2\ln\dfrac{v_f}{\dot{U}}\right)}{\dfrac{E(\alpha, \sqrt{3}/2)}{\sin\alpha} + \dfrac{m_1}{2}\cot\alpha - \dfrac{m_2}{2\sin\alpha}}\right\}$$

wherein $t_o$ = original thickness of side wall,
$t_f$ = final thickness of side wall,
Exp = exponential function,
$\sigma_{xb}$ = back pull stress,
$\sigma_o$ = flow stress of solid rod specimen of workpiece material,
$m_1$ = die friction factor,
$m_2$ = punch friction factor,
L = length of substantially cylindrical portion of die,
E $(\alpha, \sqrt{3}/2)$ = elliptic integral of second kind,
$v_f$ = final velocity of workpiece,
U = velocity of punch.

4. A method as defined in claim 3, including the step of applying a weighted power $j$ to said workpiece in accordance with the equation $$j = \frac{v_f}{\dot{U}}\left\{\frac{E(\alpha, \sqrt{3}/2)}{\sin\alpha}\ln\frac{t_o}{t_f} + \frac{1-\cos\alpha}{\sin\alpha} + \frac{m_1}{2\sin\alpha}\left[(\cos\alpha)\ln\frac{t_o}{t_f} + \frac{L}{t_f}\sin\alpha\right] + \frac{\sigma_{xb}}{2\sqrt{3}\,\sigma_o} + \frac{m_2}{2\sin\alpha}\left[2\ln\frac{v_f}{\dot{U}} + \frac{t_o/t_f}{v_f/\dot{U}} - 1 - \ln\frac{t_o}{t_f} + \left(1 - \frac{1}{v_f/\dot{U}}\right)\left(-\cos\alpha + \frac{L}{t_f}\sin\alpha\right)\right]\right\}.$$

5. A method as defined in claim 4, wherein the magnitude of said weighted power is minimized by said forward slip being in agreement with the equation $$\frac{v_f}{\dot{U}} = \mathrm{EXP}\left\{\frac{\sin\alpha}{m_2}\left[\frac{E(\alpha, \sqrt{3}/2)}{\sin\alpha}\ln\frac{t_o}{t_f} + \frac{1-\cos\alpha}{\sin\alpha} + \frac{\sigma_{xb}}{2\sqrt{3}\,\sigma_o} + \frac{m_1}{2\sin\alpha}\left(\cos\alpha\ln\frac{t_o}{t_f} + \frac{L}{t_f}\sin\alpha\right) + \frac{m_2}{2\sin\alpha}\left(1 - \ln\frac{t_o}{t_f} - \cos\alpha + \frac{L}{t_f}\sin\alpha\right)\right]\right\}$$

6. In a method of making a hollow workpiece with the aid of a punch and a die having an aperture extending therethrough; the steps of providing said workpiece with a side wall; causing said punch to engage the interior of said hollow workpiece so that the latter is positioned on said punch; causing movement of said punch with said workpiece thereon relative to said die and into said aperture thereof at an operational speed to iron said workpiece and thereby reduce the thickness and increase the length of said side wall; forcing said workpiece to leave said die at a speed exceeding said operational speed of the punch so as to cause forward slip of the ironed portion of said workpiece with respect to said punch; and stripping said workpiece from said punch by moving said workpiece and punch relative to each other, and stripping being started while said forward slip is still in progress so that said forward slip and the stripping movement will blend with each other and form a continuous motion until said stripping is completed.

7. In a method of making a cup-shaped workpiece with the aid of a punch and a die having an aperture extending therethrough; the steps of providing said workpiece with a side wall; causing said punch to engage the interior of said hollow workpiece so that the latter is positioned on said punch; causing movement of said punch with said workpiece thereon relative to said die and into said aperture thereof at an operational speed to iron said workpiece and thereby reduce the thickness and increase the length of said side wall; forcing said workpiece to leave said die at a speed exceeding said operational speed of the punch so as to cause forward slip of the ironed portion of said workpiece with respect to said punch; and introducing a fluid under pressure into said cup-shaped workpiece at the time said workpiece is about to leave said die so as to maintain said forward slip and simultaneously start to strip said workpiece from said punch.

8. A method as defined in claim 7, wherein after leaving said die, said workpiece is subjected to the action of mechanical stripping means arranged to complete the stripping step in conjunction with said fluid under pressure.

9. A method as defined in claim 7, wherein said pressure is of a magnitude sufficient to completely strip said workpiece from said punch.

10. In apparatus for making a hollow workpiece having a side wall; a punch for engaging the interior of said hollow workpiece so that the latter is positioned on said punch; a die having an aperture extending therethrough; means for causing movement of said punch with said workpiece thereon relative to said die and into said aperture thereof at an operational speed to iron said workpiece and thereby reduce the thickness and increase the length of said side wall; means for subjecting said workpiece to a relatively large frictional force at said punch and a small frictional force at said die, and for forcing said workpiece to leave said die at a speed exceeding said operational speed of the punch so as to cause forward slip of the ironed portion of said workpiece with respect to said punch; and means for controlling said forward slip of the ironed portion.

11. Apparatus as defined in claim 10, in which said aperture of the die includes a substantially conical portion having a semi-cone angle $\alpha$ and a substantially cylindrical portion adjacent to said conical portion, and in which said punch and said aperture of the die are dimensioned and arranged to cause a reduction in thickness of said side wall exceeding the value resulting from the equation $$\frac{t_o}{t_f} = \text{EXP}\left\{\frac{\frac{-\sigma_{xb}}{(2/\sqrt{3})\cdot\sigma_o} - \frac{1-\cos\alpha}{\sin\alpha} - \frac{m_1}{2}\frac{L}{t_f} - \frac{m_2}{2\sin\alpha}\left(1-\cos\alpha + \frac{L}{t_f}\sin\alpha\right)}{\frac{E(\alpha, \sqrt{3}/2)}{\sin\alpha} + \frac{m_1}{2}\cot\alpha - \frac{m_2}{2\sin\alpha}}\right\}$$

wherein $t_o$ = original thickness of side wall,
$t_f$ = final thickness of side wall,
Exp = exponential function,
$\sigma_{xb}$ = back pull stress,
$\sigma_o$ = flow stress of solid rod specimen of workpiece material,
$m_1$ = die friction factor,
$m_2$ = punch friction factor,
L = length of substantially cylindrical portion of die,
E ($\alpha$, $\sqrt{3}/2$) = elliptic integral of second kind.

12. Apparatus as defined in claim 10, in which said aperture of the die includes a conical portion having a semi-cone angle $\alpha$ and a substantially cylindrical portion adjacent to said conical portion, and said semi-cone angle $\alpha$ is in agreement with the expression $$2E(\alpha, \sqrt{3}/2) + m_1 \cos\alpha - m_2 < 0$$

and in which said punch and said aperture of the die are dimensioned to produce a reduction in thickness of said side wall in accordance with the equation $$\frac{t_o}{t_f} = \text{EXP}\left\{\frac{-\frac{\sigma_{xb}}{(2/\sqrt{3})\sigma_o} - \frac{1-\cos\alpha}{\sin\alpha} - \frac{m_1}{2}\cdot\frac{L}{t_f} - \frac{m_2}{2\sin\alpha}\left(1-\cos\alpha + \frac{L}{t_f}\sin\alpha + 2\ln\frac{v_f}{\dot{U}}\right)}{\frac{E(\alpha, \sqrt{3}/2)}{\sin\alpha} + \frac{m_1}{2}\cot\alpha - \frac{m_2}{2\sin\alpha}}\right\}$$

wherein $t_o$ = original thickness of side wall,
$t_f$ = final thickness of side wall,
Exp = exponential function,
$\sigma_{xb}$ = back pull stress,
$\sigma_o$ = flow stress of solid rod specimen of workpiece material,
$m_1$ = die friction factor,
$m_2$ = punch friction factor,
L = length of substantially cylindrical portion of die,
E ($\alpha$, $\sqrt{3}/2$) = elliptic integral of second kind,
$v_f$ = final velocity of workpiece,
$\dot{U}$ = velocity of punch.

13. In apparatus for making a hollow workpiece having a side wall; a punch for engaging the interior of said hollow workpiece; a die having an aperture extending therethrough; means for causing movement of said punch with said workpiece thereon relative to said die and into said aperture thereof at an operational speed to iron said workpiece and thereby reduce the thickness and increase the length of said side wall; means for forcing said workpiece to leave said die faster than said punch so as to cause forward slip of the ironed portion of said workpiece with respect to said punch; and means for stripping said workpiece from said punch, said last-named means being arranged to start the stripping while said forward slip is still in progress.

14. In apparatus for making a cup-shaped workpiece having a side wall; a punch for engaging the interior of said cup-shaped workpiece; a die having an aperture extending therethrough; means for causing movement of said punch with said workpiece thereon relative to said die and into said aperture thereof at an operational speed to iron said workpiece and thereby reduce the thickness and increase the length of said side wall; means for forcing said workpiece to leave said die faster than said punch so as to cause forward slip of the ironed portion of said workpiece with respect to said punch; and additional means for introducing a fluid under pressure into said cup-shaped workpiece so as to promote said forward slip and start to strip and workpiece from said punch while said forward slip is still in progress.

15. Apparatus as defined in claim 14, including mechanical stripping means arranged to complete the stripping in conjunction with said fluid under pressure.

16. Apparatus as defined in claim 14, wherein said pressure is of a magnitude sufficient to complete the stripping of said workpiece from said punch.

17. Apparatus as defined in claim 14, including control means for actuating said additional means at the time said workpiece is about to leave said die.

* * * * *

UNITED STATES PATENT AND TRADEMARK OFFICE

CERTIFICATE OF CORRECTION

PATENT NO. : 3,942,351

DATED : March 9, 1976

INVENTOR(S) : Betzalel Avitzur

It is certified that error appears in the above-identified patent and that said Letters Patent are hereby corrected as shown below:

Column 3, Eq. (1b), $\sqrt{3/2}$ should read $\sqrt{3}/2$. From column 5, line 7, through column 12, line 61, parenthesize each of the equation numerals 3, 4, 5, 7, 8, 9, 21a, 21b, 21c, 21d, and 27 positioned adjacent to the respective equation at the right hand side thereof. From column 5, line 39, through column 8, line 52, change "$\gamma_1$", each occurrence, to -- $\Gamma_1$ --. From column 5, line 50, through column 9, line 16, change "$\gamma_2$", each occurrence, to -- $\Gamma_2$ --. Column 8, Eq. (15), $E(\alpha, \sqrt{3/2})$ should read $E(\alpha,\sqrt{3}/2)$. Column 9, Eq. (19), before "L" delete the parenthetic mark "(". Column 10, Eq. (22a), $\frac{\sigma_o}{3}$ should read $\frac{\sigma_o}{\sqrt{3}}$, and $\frac{\dot{U}}{v_f}$ 1 should read $\frac{\dot{U}}{v_f} - 1$. Column 11, Eq. (23b), $\frac{L}{tf}$ should read $\frac{L}{t_f}$ ; Eq. (24a), insert a horizontal line under the

UNITED STATES PATENT AND TRADEMARK OFFICE

CERTIFICATE OF CORRECTION

PATENT NO. 3,942,351

DATED March 9, 1976

INVENTOR(S) : Betzalel Avitzur

It is certified that error appears in the above-identified patent and that said Letters Patent are hereby corrected as shown below:

numerator 1 - cos $\alpha$. Column 13, Eq. (28a), $-\{\frac{\sin\alpha}{m_2}$ should read $\{-\frac{\sin\alpha}{m_2}$, and after $\frac{m_2}{2\sin\alpha}$ insert a parenthetic mark -- ( --. Column 18, lines 31 to 40 (claim 2), the equation should read like Eq. (29). Column 19, lines 12 to 21 (claim 3), the equation should read like Eq. (30a); line 36, change "U" to -- $\dot{U}$ --; lines 40 to 50 (claim 4), the equation should read like Eq. (24a); lines 56 to 68 (claim 5), the equation should read like Eq. (28a) as corrected. Column 22, line 42 (claim 14), change "and" (second occurrence) to -- said --.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*